US008590208B1

(12) United States Patent
Nuss et al.

(10) Patent No.: US 8,590,208 B1
(45) Date of Patent: Nov. 26, 2013

(54) GAP COVER FOR WINDOW SHUTTER ASSEMBLY

(75) Inventors: Steven M. Nuss, Oceanside, CA (US); David Nuss, Houston, TX (US)

(73) Assignee: Peek Guard, Inc., Houston, TX (US)

( * ) Notice: Subject to any disclaimer, the term of this patent is extended or adjusted under 35 U.S.C. 154(b) by 0 days.

(21) Appl. No.: 13/463,463

(22) Filed: May 3, 2012

Related U.S. Application Data

(60) Provisional application No. 61/519,883, filed on Jun. 1, 2011.

(51) Int. Cl.
*E06B 7/086* (2006.01)

(52) U.S. Cl.
USPC ..... 49/87.1

(58) Field of Classification Search
USPC ..... 49/74.1, 87.1
See application file for complete search history.

(56) References Cited

U.S. PATENT DOCUMENTS

| | | | | | |
|---|---|---|---|---|---|
| 103,854 | A * | 6/1870 | Donato | 49/74.1 |
| 163,679 | A * | 5/1875 | Merrill | 49/87.1 |
| 213,343 | A * | 3/1879 | Morstatt | 49/87.1 |
| 863,573 | A * | 8/1907 | McCord | 49/74.1 |
| 4,715,421 | A * | 12/1987 | Erber | 160/133 |
| 5,598,664 | A * | 2/1997 | Grice | 49/74.1 |
| 6,401,391 | B2 * | 6/2002 | Gabriele | 49/87.1 |
| 8,136,298 | B1 * | 3/2012 | Johnston | 49/64 |
| 2001/0037604 | A1 * | 11/2001 | Gabriele | 49/74.1 |
| 2003/0101653 | A1 * | 6/2003 | Biro | 49/74.1 |
| 2004/0226221 | A1 * | 11/2004 | Regnery | 49/74.1 |
| 2006/0042164 | A1 * | 3/2006 | Downey | 49/74.1 |
| 2010/0199562 | A1 * | 8/2010 | Yang | 49/92.1 |

* cited by examiner

*Primary Examiner* — Jerry Redman
(74) *Attorney, Agent, or Firm* — Blakely, Sokoloff, Taylor & Zafman

(57) ABSTRACT

A gap cover for a shutter assembly is described herein. The gap cover includes a first member for coupling the gap cover to the shutter assembly, and a second member to block line of sight between a plurality of louvers and a stile of the shutter assembly. In some embodiments of the invention, the first member is configured for coupling the gap cover to one or more louver pins of the shutter assembly, the louver pin(s) for moving the louvers to an open/closed position. In other embodiments, the first member is configured for coupling the gap cover to one or more of the louvers. The second member may be positioned perpendicular to the first member or non-perpendicularly to the first member. Furthermore, first member may include coupling mechanisms placed in a fixed position, or in an adjustable position, for coupling the gap cover to the shutter assembly.

8 Claims, 7 Drawing Sheets

GAP COVER FOR WINDOW SHUTTER ASSEMBLY

CLAIM OF PRIORITY

This application claims priority to Provisional Application No. 61/519,883 filed on Jun. 1, 2011.

TECHNICAL FIELD

Embodiments of the invention relate generally to window coverings and more particularly to gap coverings for window shutter assemblies.

BACKGROUND

Window shutter assemblies, such as plantation shutters, are solid and stable window coverings used at the interior or exterior of a window. These shutter assemblies may be employed for a variety of reasons, including controlling the amount of sunlight that enters a room, to provide privacy, to protect against weather and to enhance the aesthetics of a building. On some styles of buildings it is common to have such shutters cover doors as well as windows.

FIG. 1 is an illustration of a prior art window shutter assembly. Shutter assembly 100 has a frame including stiles 102 and 104, and rails 106 and 108. Louvers 110 are pivotably supported by the frame in a horizontal configuration, as shown (having said louvers in a vertical configuration is also possible).

Louver pins 112 and 114 pivotably couple louvers 110 to the stiles 102 and 104, respectively. The placement of said louver pins between the louvers and the stiles creates gaps 122 and 124. These gaps do not block light from being emitted from the window, and these gaps create the possibility of someone peeking in through the gaps when louvers 110 are in the closed position, creating privacy concerns for the user. What is needed is a product that enhances the light blocking ability of window shutter assemblies, such as assembly 100, and also addresses the potential privacy concerns of a user created by gaps 122 and 124.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. It should be appreciated that the following figures may not be drawn to scale.

Descriptions of certain details and implementations follow, including a description of the figures, which may depict some or all of the embodiments described below, as well as discussing other potential embodiments or implementations of the inventive concepts presented herein. A more detailed description with reference to the drawings is provided below.

DETAILED DESCRIPTION

Embodiments of an apparatus functioning as a gap cover for a window shutter assembly are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 2A:
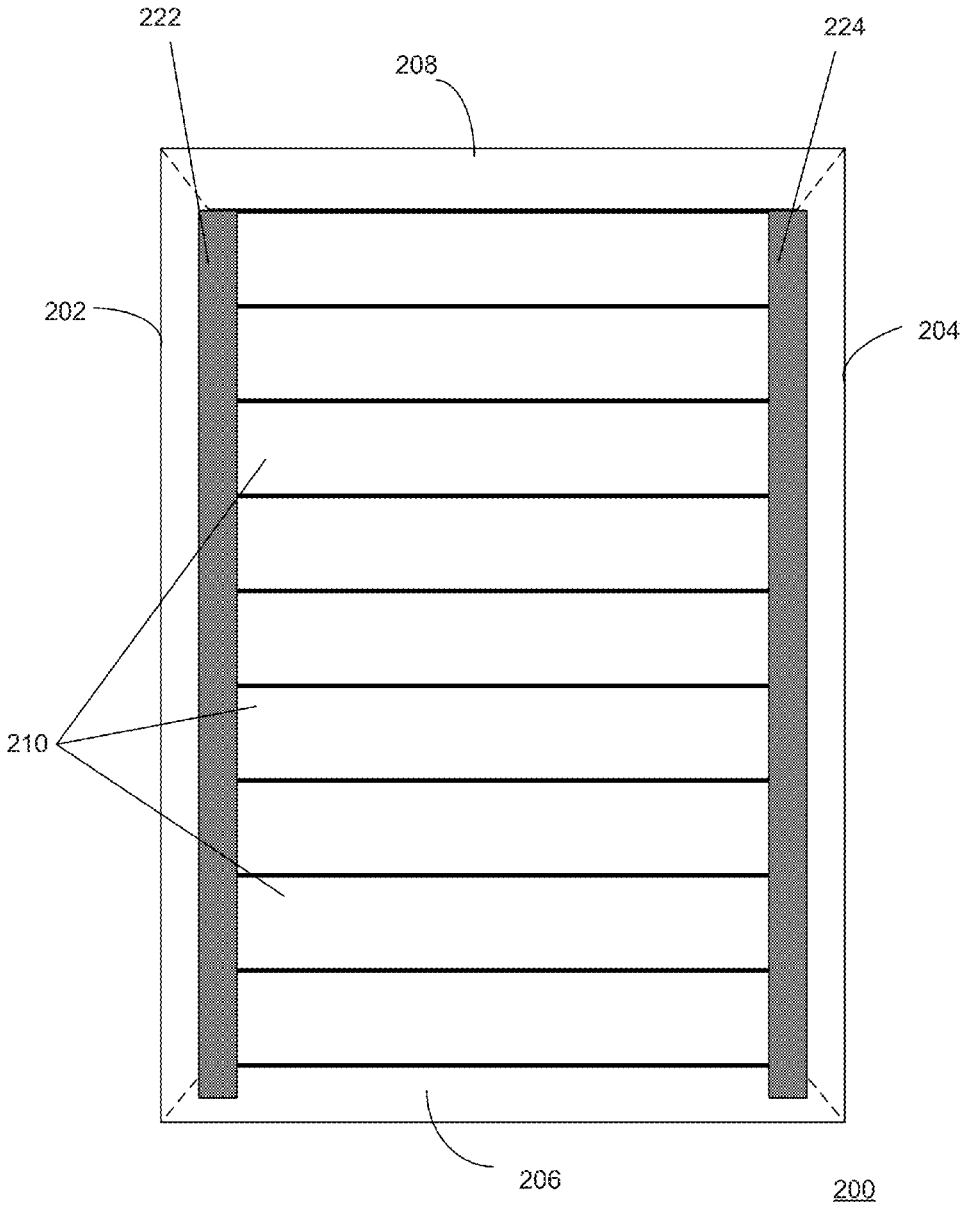
FIG. 2A-FIG. 2D are illustrations of a window shutter assembly and gap cover assembly according an embodiment of the invention.

FIG. 2A-FIG. 2D are illustrations of a window shutter assembly and gap cover assembly according an embodiment of the invention. FIG. 2A is an illustration of a window shutter assembly, with its louvers in a closed position, utilizing an embodiment of the invention as described below. Shutter assembly 200 has a frame comprising stiles 202 and 204, and rails 206 and 208. While louvers 210 are shown, in this exemplary embodiment, to be pivotably supported by the frame in a horizontal configuration, in other embodiments said louvers may be configured in a vertical configuration.

Figure 1:
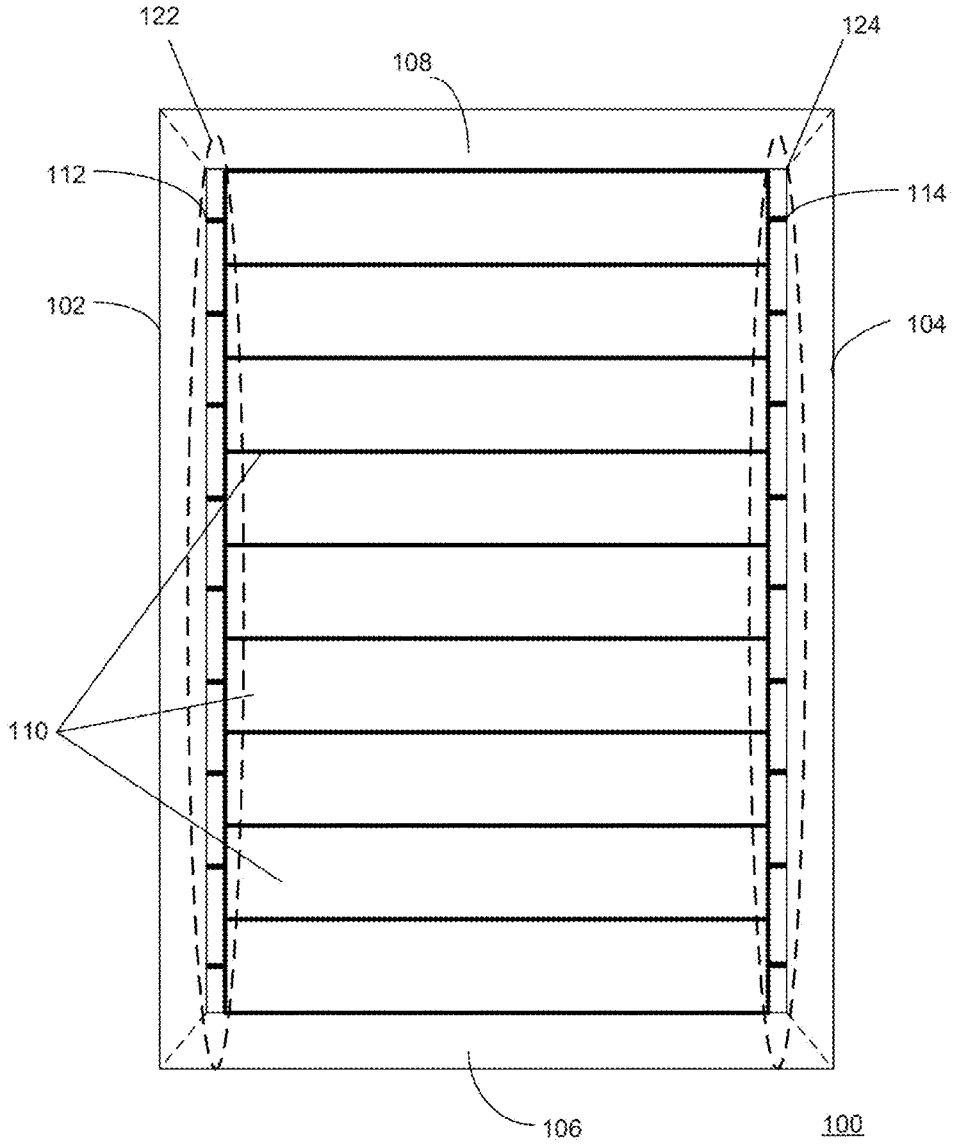
FIG. 1 (Prior Art)
FIG. 1 is an illustration of a prior art window shutter assembly.

Shutter assembly 200 utilizes louver pins to pivotably couple louvers 210 to the stiles 202 and 204, respectively. As discussed above with respect to prior art shutter assembly 100 of FIG. 1, the placement of said louver pins between the louvers and the stiles creates gaps that permit light to be emitted from the window, and allow for the possibility of someone peeking in through the gaps when the louvers are in the closed position, creating privacy concerns for the user.

In this embodiment, gap covers 222 and 224 are utilized to eliminate the above described gaps when louvers 210 are in the closed position, as shown in FIG. 2A. Thus, gap covers 222 and 224, when used on both end of louvers 210 as shown, block out the ability to see through the gap between the louver and the stile, and also eliminate the direct light that comes through the same gap.

Figure 2B:
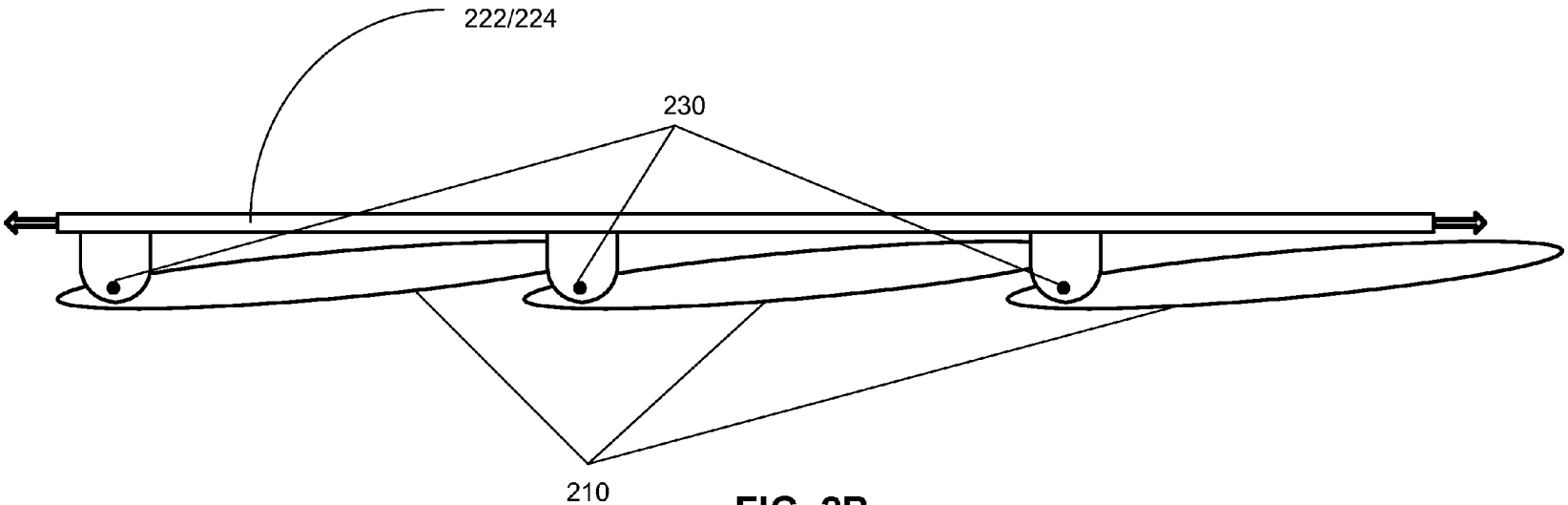

FIG. 2B is a side profile view of a gap cover (i.e., either gap cover 222 or 224) and louvers 210 when the louvers are in a closed position. As shown in this embodiment, gap cover 222/224 includes coupling mechanism 230 for coupling the gap cover to louvers 210. In this embodiment, coupling mechanism 230 is shown to couple to each of louvers 210; in other embodiments, gaps covers may be coupled to a subset of louvers of a window shutter assembly (i.e., two or more louvers). Furthermore, while gap cover 222/224 is shown to be coupled to louvers 210, in other embodiments, said gap cover may be coupled to components of the pivoting mechanisms of the window assembly, such as louver pins, as opposed to portions of the louvers.

Coupling mechanism 230 is shown to be formed holes for allowing gap cover 222/224 to be coupled to louvers 210 via a screw/nut pair, a snap clamp, or any functionally equivalent fastening means.

Figure 2C:
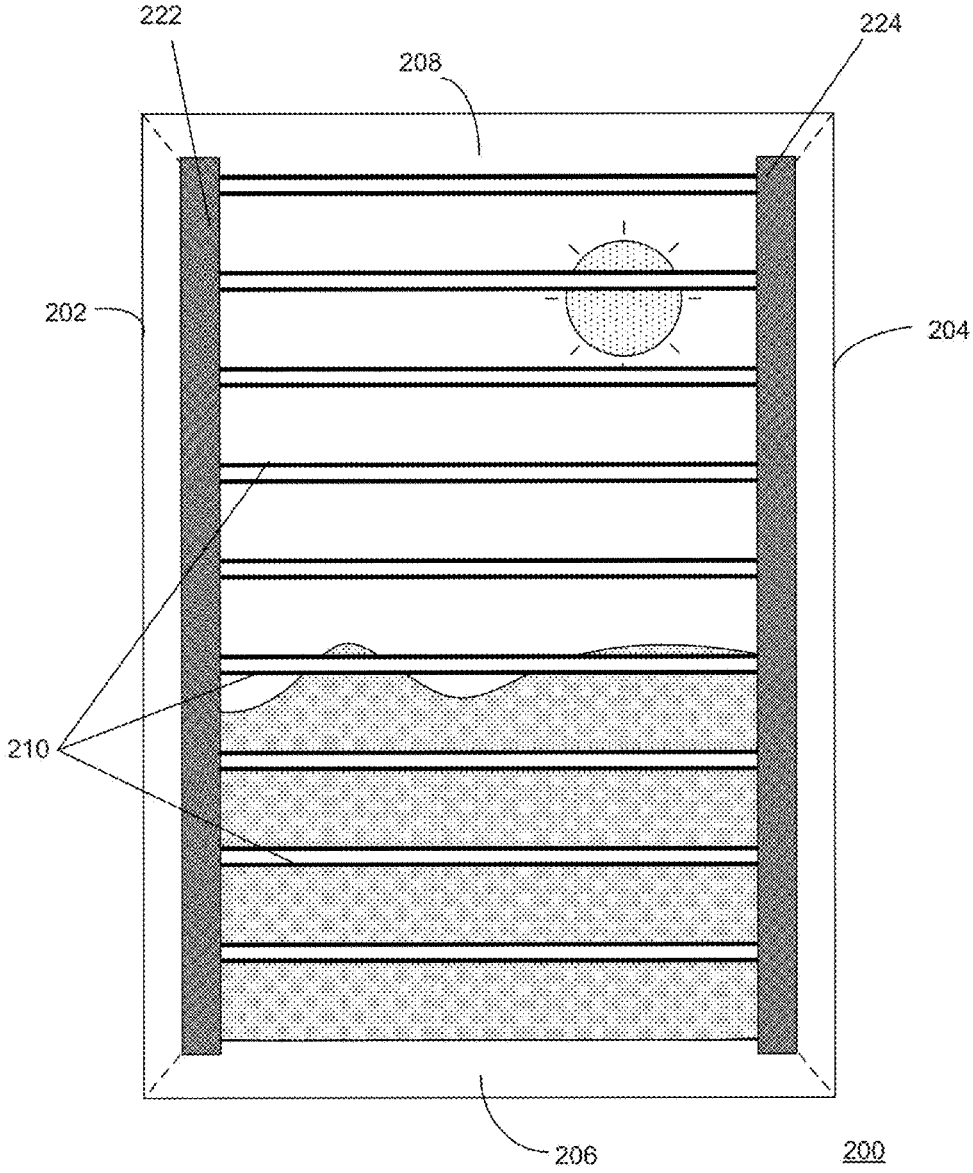

FIG. 2C is an illustration of shutter assembly 200 in the open position, according to an embodiment of the invention. Gap covers 222 and 224 are shown to move in conjunction with louvers 210 due to being coupled to the louvers. Louvers 210 may open and close via any means known in the art—i.e., operated from a closed position to an open position and back to the closed position by turning one of the louvers manually, via a control rod coupled to two or more louvers (not shown), etc. In some embodiments, gap covers 222 and 224 may function as the above described control rod for opening/closing louvers 210. Whatever means used to move louvers 210 cause the associated gear assembly to rotate, thereby causing said louvers to translate downwardly or upwardly within shutter assembly 200.

Figure 2D:
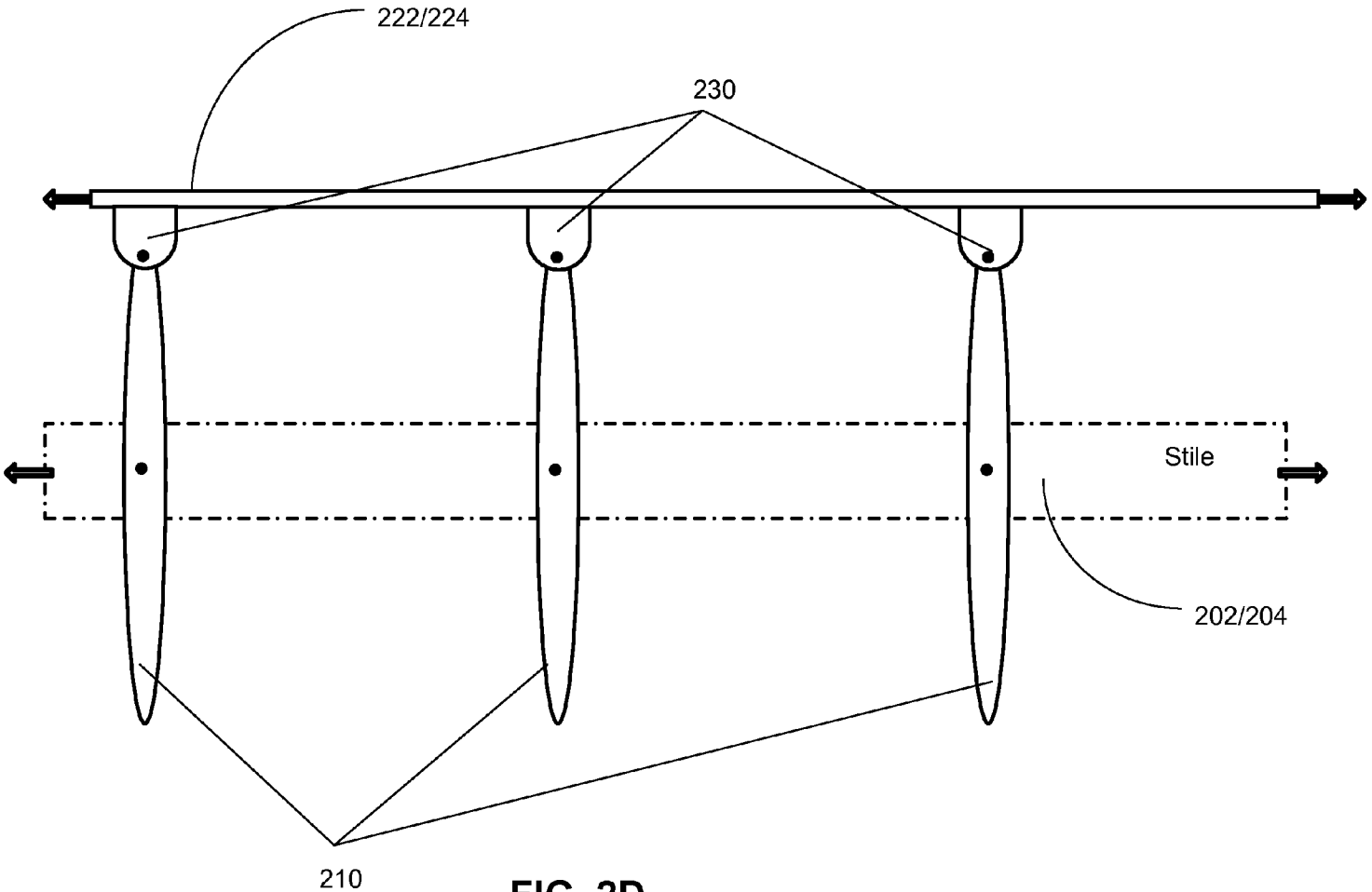

FIG. 2D is a side profile view of a gap cover (i.e., either gap cover 222 or 224) and louvers 210 when the louvers are in an open position. As shown in this embodiment, by having gap cover 222/224 coupled to louvers 210 via coupling means 230, said gap covers extend away for the stile (i.e., stile 202 or 204), and do not affect said louvers from remaining in an open position to allow light through shutter assembly 200. Thus, gap covers 222 and 224 eliminate the possibility of someone peeking in through the gaps that exist in prior art solutions (such as shutter assembly 100 of FIG. 1) when louvers 210 are in the closed position.

Thus, embodiments of the invention may be used for window shutter assemblies, such as plantation shutters, used at the interior or exterior of a window. Shutter assemblies are employed for a variety of reasons, including controlling the amount of sunlight that enters a room, to provide privacy, to protect against weather and to enhance the aesthetics of a building. On some styles of buildings it is common to have such shutters cover doors as well as windows. As described above, embodiments of the invention enhance the privacy capabilities and, in some embodiments, the light blocking capabilities of existing shutter assemblies, without compromising the aesthetics of said assemblies. Furthermore, embodiments of the invention may be utilized with any pre-manufactured window assembly—i.e., embodiments of the invention do not require structural modifications to prior art window shutter assemblies.

Figure 3B:
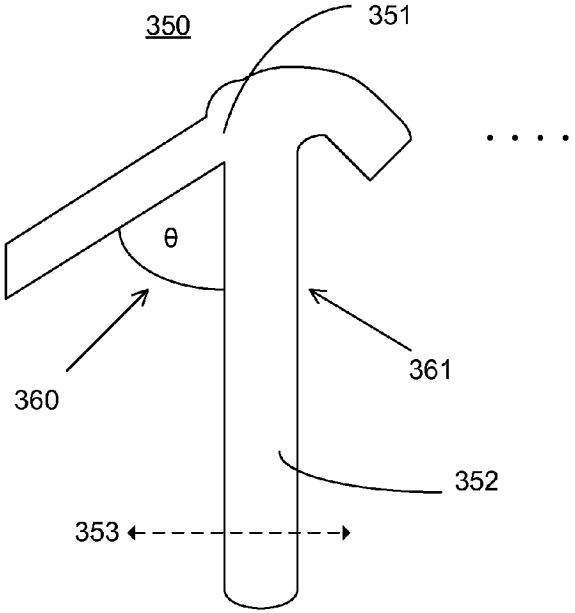
FIG. 3A and FIG. 3B are illustrations of portions of gap cover assemblies according to embodiments of the invention.
Figure 3A:
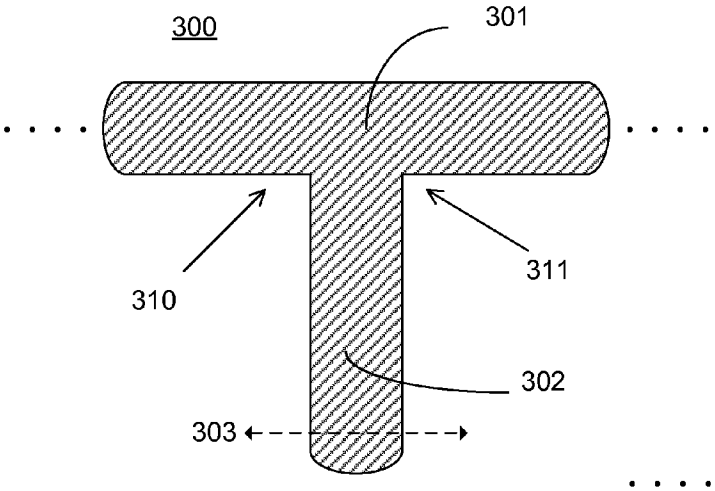

FIG. 3A and FIG. 3B are illustrations of portions of gap cover assemblies according to embodiments of the invention. Gap cover assembly 300, as shown in FIG. 3A, is illustrated to include first member 301 for blocking line-of-sight through any gap created by louvers of a shutter assembly, and second member 302 for coupling to a louver (or alternatively, a gear, as described above) via formed (e.g., pre-drilled) hole 303. In this embodiment, gap cover assembly 300 includes side 310 for overlapping one or more louvers of a shutter assembly, and side 311 for overlapping a stile of a shutter assembly. In this embodiment, members 301 and 302 are shown to be relatively perpendicular such that gap cover 300 is relatively flush with the shutter assembly when, for example, said louvers in the closed position are relatively aligned with stiles of the shutter assembly.

Gap cover assembly 350, as shown in FIG. 3B, is illustrated to include first member 351 for blocking line-of-sight through any gap created by louvers of a shutter assembly, and second member 352 for coupling to a louver (or alternatively, a gear, as described above) via formed hole 353. In this embodiment, gap cover assembly 350 includes side 360 for overlapping one or more louvers of a shutter assembly, and side 361 for overlapping a stile of a shutter assembly. In this embodiment, members 351 and 352 are shown to be non-perpendicular—said members may be placed at an angle where each side more closely contacts the louvers and stiles of the shutter assembly when the louvers are in the closed position (e.g., angle θ for side 360 may be roughly 67 degrees for an appropriately shaped louver). Furthermore, in some embodiments, the positioning/placement of the members 351 and 352 may be chosen to emphasize blocking line-of-sight through any gap created by louvers of a shutter assembly over blocking light emitted from said gap; in other words, some embodiments of the invention are formed to mainly address the privacy concerns of prior art shutter assemblies.

Figure 4:
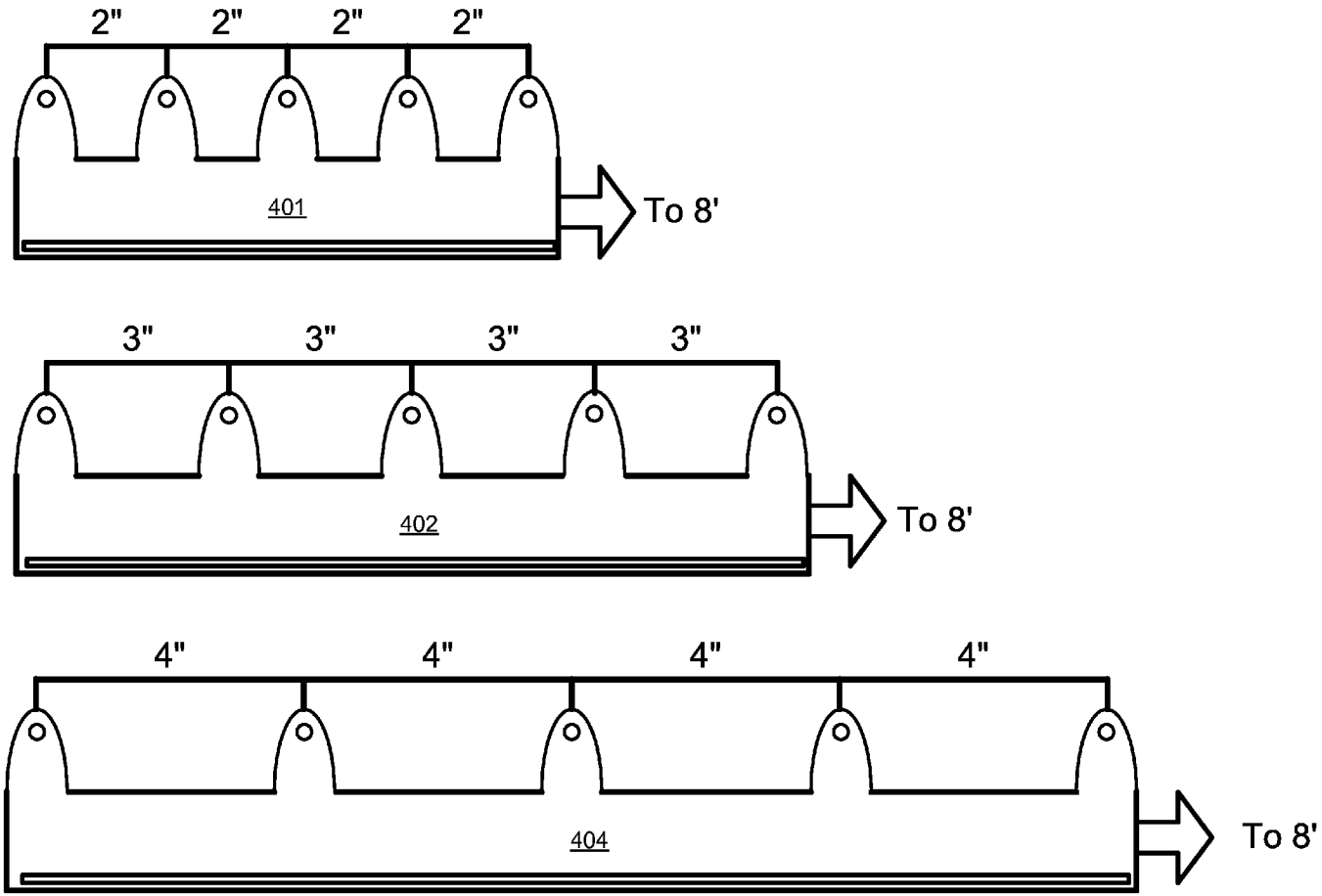
FIG. 4 illustrates gap covers having coupling mechanisms spaced according to various embodiments of the invention.

FIG. 4 illustrates gap covers having coupling mechanisms spaced according to various embodiments of the invention. In this embodiment, gap cover 401 is shown to include coupling mechanisms (e.g., formed/pre-drilled holes such as those illustrated in FIGS. 3A and 3B) spaced two inches apart for an 8 foot long gap cover—thereby functioning as a gap cover for an 8 foot shutter assembly having two inch louvers. Gap cover 402 is shown to include coupling mechanisms spaced three inches apart for an 8 foot long gap cover—thereby functioning as a gap cover for an 8 foot shutter assembly having three inch louvers. And lastly, gap cover 403 is shown to include coupling mechanisms spaced four inches apart for an 8 foot long gap cover thereby functioning as a gap cover for an 8 foot shutter assembly having four inch louvers.

The illustrated embodiments show, that for gap covers coupled to a plurality of louvers, said coupling mechanisms may be spaced respective to the corresponding shutter assembly to ensure a strong fit, to further function as a control/tilt rod, etc. In other embodiments of the invention, a gap cover may include configurable coupling mechanisms (e.g., adjustable, removable, etc.) such that spacing of the coupling mechanisms may be adjusted to be aligned with louvers and/or gear assemblies of a given shutter assembly.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. A shutter unit comprising:

a frame having a first stile, a second stile opposite the first stile, a first rail coupled to the first and second stiles, and a second rail opposite the first rail and coupled to the first and second stiles;

a plurality of shutter louvers;

a first set of louver pins to pivotably couple the shutter louvers to the first stile;

a second set of louver pins to pivotably couple the shutter louvers to the second stile;

a first gap cover positioned between the first stile and the plurality of shuttle louvers to block line of sight between the first stile and the plurality of shutter louvers when the shutter louvers are in a closed position;

a second gap cover positioned between the second stile and the plurality of shuttle louvers to block line of sight between the second stile and the plurality of shutter louvers when the shutter louvers are in the closed position; and a control rod coupled to the plurality of shutter louvers for opening and closing the shutter louvers and the first and second gap covers.

2. The shutter unit of claim 1, wherein the first and second gap covers are each coupled to one or more louver pins of the first and second set of louver pins, respectively.

3. The shutter unit of claim 1, wherein the first and second gap covers are each coupled to one or more of the plurality of shutter louvers.

4. The shutter unit of claim 3, wherein the first and second gap covers each comprise:

a first member for coupling the gap cover to the plurality of louvers; and a second member to block line of sight between the plurality of shutter louvers and the respective stile.

5. The shutter unit of claim 4, wherein the second member of each gap cover is positioned perpendicular to the first member of each gap cover.

6. The shutter unit of claim 4, wherein the second member of each gap cover is positioned non-perpendicularly to the first member of each gap cover.

7. The shutter unit of claim 1, wherein the plurality of shutter louvers comprise vertically oriented shutter louvers, and the first and second stiles comprise top and bottom stiles, respectively.

8. The shutter unit of claim 1, wherein the plurality of shutter louvers comprise horizontally oriented shutter louvers, and the first and second stiles comprise left and right stiles, respectively.

* * * * *